United States Patent [19]

Korosec

[11] Patent Number: 4,486,324

[45] Date of Patent: Dec. 4, 1984

[54] HYDRAULIC FLUIDS

[75] Inventor: Philip S. Korosec, Ballwin, Mo.

[73] Assignee: Edwin Cooper, Inc., St. Louis, Mo.

[21] Appl. No.: 318,744

[22] Filed: Nov. 6, 1981

[51] Int. Cl.[3] ..... C10M 1/06

[52] U.S. Cl. ..... 252/49.3; 252/32.7 E; 252/33.4; 252/49.5; 252/51.5 A; 252/56 R; 252/75; 252/76; 252/78.1; 252/78.5; 252/79

[58] Field of Search ..... 252/75, 76, 78.1, 78.5, 252/79 R, 79 HF, 32.7 E, 49.3, 49.5, 51.5 A, 56 R, 33.4

[56] References Cited

U.S. PATENT DOCUMENTS

| | | | |
|---|---|---|---|
| 3,024,198 | 3/1962 | Harrington | 252/49.5 |
| 3,216,936 | 11/1965 | Suer | 252/32.7 |
| 3,219,666 | 11/1965 | Norman et al. | 252/75 |
| 3,231,587 | 1/1966 | Rense | 252/56 D |
| 3,255,108 | 6/1966 | Wiese | 252/32.7 |
| 3,269,946 | 8/1966 | Wiese | 252/32.5 |
| 3,489,682 | 1/1970 | Lesuer | 252/32.7 E |
| 4,118,331 | 10/1978 | Jahnke | 252/32.7 E |
| 4,219,434 | 8/1980 | Ellis | 252/78.1 |
| 4,225,447 | 9/1980 | Law et al. | 252/34.7 |
| 4,257,902 | 3/1981 | Singer | 252/49.5 |
| 4,313,836 | 2/1982 | Nassry et al. | 252/78.5 |
| 4,354,949 | 10/1982 | Eggers et al. | 252/49.5 |

FOREIGN PATENT DOCUMENTS 2032951 5/1980 United Kingdom .

*Primary Examiner*—Paul Lieberman
*Assistant Examiner*—Hoa Van Le
*Attorney, Agent, or Firm*—Donald L. Johnson; John F. Sieberth; Willard G. Montgomery

[57] ABSTRACT

An aqueous hydraulic fluid comprising at least 80 percent water and containing a hydrocarbyl-substituted succinic acid, a zinc dihydrocarbyl dithiophosphate, a hydroxyalkylamine, sodium alkylbenzene sulfonate, and optionally, a polyalkylene glycol mono-fatty acid ester.

14 Claims, No Drawings

HYDRAULIC FLUIDS

Background

Hydraulic fluids have been used for many years for many purposes. They are especially useful as a means of transferring a mechanical force through a high pressure fluid acting against a piston. Pumps used to produce the high pressures operate under extreme stress. In the past, hydrocarbon fluids with additives such as zinc dialkyl dithiophosphate have been used for this purpose. Recently, such hydrocarbons have become more expensive. Furthermore, such hydrocarbon fluids present a fire hazard in the event that a ruptured hydraulic line sprays hydrocarbon fluid at an ignition source.

In view of the above, interest has been developing in the use of aqueous hydraulic fluids. These are nonflammable but they lack the inherent lubricity of hydrocarbon-based fluids. Because of this special additive, combinations can be developed to permit the use of water-based hydraulic fluids. One such fluid is described in GB No. 2,032,951A.

Summary

According to the present invention there is provided an aqueous hydraulic fluid comprising at least 80 percent water, a hydrocarbyl substituted succinic acid, a zinc hydrocarbyl dithiophosphate, a hydroxyalkyl amine, sodium alkyl benzene sulfonate, and optionally, polyalkylene glycol fatty acid ester.

Description of the Preferred Embodiment

A preferred embodiment of the invention is an aqueous hydraulic fluid comprising (a) at least 80 weight percent water, (b) a hydrocarbyl substituted succinic acid, (c) a zinc dihydrocarbyl dithiophosphate, (d) a hydroxyalkylamine, and (e) sodium alkylbenzene sulfonate.

A more preferred embodiment of the invention is an aqueous hydrualic fluid comprising (a) at least 80 weight percent water, (b) about 0.1–5 weight percent polybutene substituted succinic acid wherein said polybutene substituent has a molecular weight of about 300–5000, (c) about 0.1–5 weight percent of a zinc di-$C_{3-12}$ alkyl dithiophosphate, (d) about 0.05–5 weight percent of a hydroxyethyl amine and (e) about 0.1–5 weight percent of a sodium alkylbenzene sulfonate. A still more preferred embodiment of the invention is an aqueous hydraulic fluid comprising (a) at least 90 weight percent water, (b) about 0.1–3 weight percent of said polybutene substituted succinic acid, (c) about 0.1–3 weight percent of a zinc di-$C_{4-8}$ alkyl dithiophosphate, (d) about 0.1–3 weight percent of a diethanol amine an (e) about 0.1–3 weight percent of sodium alkybenzene sulfonate.

The aqueous hydraulic fluid is readily made by first making a hydraulic fluid concentrate which is then mixed with the desired amount of water to obtain the hydraulic fluid. Thus, another preferred embodiment of the invention is a hydraulic fluid concentrate adapted for addition to water to form an aqueous hydraulic fluid, said concentrate comprising (a) from about 0–20 weight percent water, (b) a hydrocarbyl substituted succinic acid, (c) a zinc dihydrocarbyl dithiophosphate, (d) a hydroxyalkyl amine and (e) a sodium alkylbenzene sulfonate.

The hydrocarbyl substituted succinic acid can be readily made by reacting an olefinically unsaturated aliphatic hydrocarbon with maleic anhydride which is hydrolyzed to form the acid. The olefins may be internal olefins but are preferably alpha-olefins such as eicosene-1, docosene-1, triacontene-1, tetracontene-1, and the like.

Preferably, the hydrocarbyl substituent is formed from a polymer of a lower aliphatic olefin containing 2 to about 12 carbon atoms such as ethylene, propylene, butene-1, isobutene, isopentene, hexene-1, dodecene-1, and the like. Such polymers can be made by well known methods such as by Friedel-Crafts catalysis. Their molecular weights range from about 200–10,000 or higher. More preferably, the olefin polymer is derived from a $C_{3-12}$ alpha-olefin and has a molecular weight of about 300–5000.

The most preferred olefin polymer used to form the succinic acid substituent is a polybutene, especially a polyisobutylene having a molecular weight of about 300–5000 and more preferably about 700–1500.

The aliphatic hydrocarbon substituted succinic acid can be made by heating a mixture of the olefin polymer and maleic anhydride at about 190°–330° C. The reaction can be catalyzed by injecting chlorine or by adding a small amount of peroxide. The anhydride is then hydrolyzed to an alkenyl succinic acid.

Zinc dihydrocarbyl dithiophosphates are well known lubricating oil additives. The hydrocarbon substituent may be aryl, or alkyl or mixtures thereof. Typical aryl groups are the alkylphenyl groups such as p-nonylphenyl. The preferred hydrocarbon substituents are alkyl. The more preferred are alkyls containing about 3-12 carbon atoms such as n-propyl, isopropyl, sec-butyl, n-butyl, isobutyl, sec-amyl, iso-amyl, n-hexyl, 2-ethylbutyl, n-octyl, iso-octyl, 2-ethylhexyl, n-decyl, 2-ethyldecyl, n-dodecyl, and the like. Both substituents may be the same or they may be different. In practice, they may be made by reacting phosphorus pentasulfide with an alcohol mixture such as a mixture of isobutyl and n-hexyl alcohols. This will form a mixed dialkyldithiophosphoric acid which is then neutralized with zinc oxide to form a mixed dithiophosphate salt.

More preferably, the alkyl groups are those containing 4-8 carbon atoms. The most preferred component is zinc O,O-di(2-ethylhexyl) dithiophosphate.

A wide range of hydroxyalkyl amines may be used. These amines have the structure

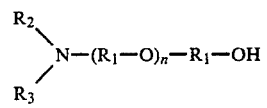

wherein $R_1$ is selected from the group consisting of divalent aliphatic hydrocarbon groups containing 2 to about 4 carbon atoms and n is an integer from 0 to about 4. $R_2$ and $R_3$ are independently selected from the group consisting of hydrogen, alkyls containing 1–12 carbon atoms and the group $$-R_1\text{-}O)_n\ R_1\text{-}OH$$

Some illustrative examples are ethanolamine, diethanolamine, triethanolamine, diethylanolmethylamine, diethanolbutylamine, di-(2-hydroxyethoxyethyl) ethylamine, 2-hydroxy propylamine, di-(2-hydroxypropyl) amine, and the like, including mixtures thereof. These components are readily made by reacting an alkenyl oxide such as ethylene oxide, propylene oxide, butylene oxide and the like with ammonia or a primary or secondary amine. The most preferred hydroxyalkylamine is diethanolamine.

A further required component is an alkali metal alkylbenzene sulfonate. These are the low molecular weight oil-soluble sulfonates. The alkyl groups can contain from about 10 to about 30 carbon atoms. A preferred range is about 12–18 carbon atoms, for example, sodium dodecyl benzene sulfonate or soduim octadecylbenzene sulfonate. A preferred component is available commercially under the trade mark Petronate L, (trade mark of Witco Chemical).

An optional but preferred fifth component of the hydraulic fluid concentrate is a fatty acid ester of a polyalkylene glycol, especially the mono fatty acid esters. The polyalkylene glycol can be polyethylene glycol, or a mixed oxyethylene-oxypropylene glycol. These contain from about 2 to 40 alkylene oxy units. More preferably, the polyalkylene glycol is a polyethylene glycol containing an average of 5 to 20 ethyleneoxy units. The still more preferred polyethylene glycols have an average molecular weight of about 200–600 and most preferably about 300.

Fatty acids used to form the esters can contain about 8–30 carbon atoms. These can be represented by octanoic acid, decanoic acid, dodecanoic acid, eicosanoic acid, triacontanoic acid, and the like. More preferably, the fatty acids used to make the esters contain about 10–20 carbon atoms such as capric acid, lauric acid, myristic acid, palmitic acid, stearic acid, arachidic acid, and mixtures thereof. The unsaturated fatty acids are also very useful such as hypogeic acid, oleic acid, elaidic acid, erucic acid, brassidic acid, behenic acid, linoleic acid, dilinoleic acid, and the like. The preferred polyglycol esters are the esters of oleic acid, in particular, the mono oleic acid esters of polyethylene glycols having a molecular weight of about 200–600. A suitable oleate ester is available commercially (Armak Chemical) under the trade mark Peg 300 which is a monooleate ester of a polyethylene glycol having a molecular weight of about 300.

The preferred amount of each component in the concentrate is as follows:

| Component | Weight percent |
|---|---|
| Polybutene-substituted succinic acid | 20–50 |
| Zinc di-($C_{3-12}$ alkyl) dithiophosphate | 10–30 |
| Hydroxyalkylamine | 3–12 |
| Sodium alkylbenzene sulfonate | 5–15 |
| Fatty acid polyalkylene glycol ester | 0–25 |
| Water | 0–20 |

A more preferred concentrate contains:

| Component | Weight percent |
|---|---|
| Polybutene-substituted succinic acid | 30–50 |
| Zinc di-($C_{4-8}$ alkyl) dithiophosphate | 15–25 |
| Diethanolamine | 3–10 |
| Sodium alkyl benzene sulfonate | 5–15 |
| Polyethylene glycol monooleate | 10–20 |
| Water | 5–15 |

The amount of each component is, of course, selected such that the total does not exceed 100 percent.

A still more preferred embodiment of the invention is a concentrate having the following composition:

| Component | Weight percent |
|---|---|
| Polyisobutene[1] substituted succinic acid | 35–45 |
| Zinc di-(2-ethylhexyl) dithiophosphate | 15–25 |
| Diethanolamine | 5–8 |
| Sodium alkylbenzene sulfonate[2] | 7–12 |
| Polyethylene glycol[3] | 12–16 |
| Water | 7–12 |

[1]Molecular weight 950
[2]Petronate L
[3]Average molecular weight 300

The actual hydraulic fluid is made from the concentrate by mixing the concentrate with water. Other components may be included as long as they do not adversely affect the performance of the hydraulic fluid. The amount of concentrate in the resulted hydraulic fluid is preferably in the range of about 1–20 weight percent depending upon the exact composition of the concentrate. In practice, a preferred mode is to adjust the concentrate composition and the amount of concentrate mixed with the water to obtain a resultant hydraulic fluid comprising:

| Component | Weight percent |
|---|---|
| Water | At least 80 |
| Hydrocarbyl substituted succinic acid | 0.1–5 |
| Zinc dihydrocarbyl dithiophosphate | 0.1–5 |
| Hydroxyalkylamine | 0.05–5 |
| Sodium alkylbenzene sulfonate | 0.1–5 |
| Fatty acid polyalkenyl glycol ester | 0.1–3 |

A more preferred mode is to use a concentrate formulated such that when added to water in an amount from about 2–10 percent, it forms a hydraulic fluid comprising:

| Component | Weight percent |
|---|---|
| Water | At least 90 |
| Polyisobutene[1] substituted succinic acid | 0.1–3 |
| Zinc di-(2-ethylhexyl) dithiophosphate | 0.1–3 |
| Diethanolamine | 0.1–3 |
| Sodium alkylbenzene sulfonate[2] | 0.1–3 |
| Polyethylene glycol[3] monooleate | 0.5-3 |

[1]Molecular weight 700–1500
[2]Petronate L
[3]Molecular weight 200–600

The most preferred hydraulic fluids have the composition:

| Component | Weight percent |
|---|---|
| Water | 94–98 |
| Polyisobutene[1] substituted succinic acid | 0.5–2.5 |
| Zinc di-(2-ethylhexyl) dithiophosphate | 0.5–1.5 |
| Diethanolamine | 0.2–0.5 |
| Sodium alkylbenzene sulfonate[2] | 0.5–1.0 |
| Polyethylene glycol[3] monooleate | 0.5–1.0 |

[1]Molecular weight 950
[2]Petronate L
[3]Molecular weight 300

The folowing examples illustrate the manner according to which the invention can be practiced.

EXAMPLE 1

In a blending vessel, place 9.0 parts by weight of water, 40 parts polyisobutenyl succinic acid (made from 950 mole weight polyisobutylene), 20 parts zinc di-(2-ethylhexyl) dithiophosphate, 10 parts soduim alkylbenzene sulfonate (Petronate L), 7 parts diethanolamine and 14 parts polyethylene glycol (mw 300) monooleate. This mixture was blended until homogeneous to obtain a useful hydraulic fluid concentrate.

EXAMPLE2

In a blending vessel, place 95 parts by weight water and 5 parts of the concentrate from Example 1. Blend this until homogeneous to obtain a very effective aqueous base hydraulic fluid containing:

| | |
|---|---|
| Water | 95.45 percent |
| Polyisobutenyl succinimide | 2.0 percent |
| Zinc di-(2-ethylhexyl) dithiophosphate | 1.0 percent |
| Sodium alkylbenzene sulfonate | 0.5 percent |
| Diethanolamine | 0.35 percent |
| Polyethylene glycol (300) monooleate | 0.7 percent |

Tests were conducted which demonstrate the effectiveness of the present hydraulic fluids. The test used the fluid according to Example 2. The test was the industry-recognized ASTM D2882 Pump Test. The test was carried out under the following conditions:

| | |
|---|---|
| Pressure | 800 psi |
| Flow Rate | 2.2-3.6 GPM |
| Sump Temperature | 115-124° F. |

The following criteria were measured:

| | Test Hours | | |
|---|---|---|---|
| | 108 | 206 | 613 |
| Weight loss (mg.) | 1803.7 | 2530.1 | 2783.4 |
| Wear Rate (mg. hr.) | 16.7 | 7.4 | 0.6 |
| Appearance | Beige | Beige | Beige |

The very low wear rate at 206 and 613 hours indicates that the composition is a useful aqueous hydraulic fluid.

I claim:

1. A substantially oil free aqueous hydraulic fluid comprising (a) at least 80 weight percent water, (b) about 0.1-5 weight percent of a polyisobutenyl substituted succinic acid said polyisobutenyl substituent having a molecular weight of 700-5000, (c) about 0.1-5 weight percent of a zinc dihydrocarbyl dithiophosphate, (d) about 0.05-5 weight percent of a hydroxyalkyl amine, and (e) about 0.1-5 weight percent of a sodium alkylbenzene sulfonate.

2. A hydraulic fluid of claim 1 wherein said zinc dihydrocarbyl dithiophosphate is a zinc di-$C_{3-12}$ alkyl dithiophosphate.

3. A hydraulic fluid of claim 2 wherein said hydroxyalkylamine is selected from the group consisting of hydroxyethylamines, hydroxypropyl amines, hydroxyethyl hydroxypropyl amines and mixtures thereof.

4. A hydraulic fluid of claim 3 comprising (a) at least 80 weight percent water, (b) about 0.1-5 weight percent polybutene substituted succinic acid wherein said polybutene substituent has a molecular weight of about 700-5000, (c) about 0.1-5 weight percent of a zinc di-$C_{3-12}$ alkyl dithiophosphate, (d) about 0.05-5 weight percent of a hydroxyethyl amine and (e) about 0.1-5 weight percent of a sodium alkylbenzene sulfonate.

5. A hydraulic fluid of claim 4 comprising (a) at least 90 weight percent water, (b) about 0.1-3 weight percent of said polybutene substituted succinic acid, (c) about 0.1-3 weight percent of a zinc di-$C_{4-8}$ alkyl dithiophosphate, (d) about 0.1-3 weight percent of diethanolamine and (e) about 0.1-3 weight percent of sodium alkylbenzene sulfonate.

6. A hydraulic fluid of claim 1 further characterized by containing a polyalkylene glycol monooleate.

7. A hydraulic fluid of claim 5 further characterized by containing about 0.5-3 weight percent of a polyethylene glycol monooleate.

8. A hydraulic fluid concentrate adapted for addition to water to form a substantially oil free aqueous hydraulic fluid, said concentrate consisting essentially of (a) from about 0-20 weight percent water, (b) about 20-50 weight percent of a polyisobutenyl-substituted succinic acid said polyisobutenyl substituent having a molecular weight of 700-5000, (c) about 10-30 weight percent of a zinc dihydrocarbyl dithiophosphate, (d) about 3-12 weight percent of a hydroxyalkyl amine and (e) about 5-15 weight percent of a sodium alkylbenzene sulfonate.

9. A concentrate of claim 8 wherein said zinc dihydrocarbyl dithiophosphate is a zinc di-$C_{3-12}$ alkyl dithiophosphate.

10. A concentrate of claim 9 wherein said hydroxyalkyl amine is selected from the group consisting of hydroxyethyl amines, hydroxypropyl amines, hydroxyethyl hydroxypropyl amines, and mixtures thereof.

11. A concentrate of claim 10 comprising (a) 0-20 weight percent water, (b) about 20-50 weight percent of said polybutene substituted succinic acid, (c) about 10-30 weight percent of said zinc di-$C_{3-12}$ alkyl dithiophosphate, (d) about 3-12 weight percent of a hydroxyethyl amine and (e) about 5-15 weight percent of a sodium alkylbenzene sulfonate.

12. A concentrate of claim 11 comprising (a) about 5-15 weight percent water, (b) about 30-50 weight percent of said polybutene substituted succinic acid, (c) about 15-25 weight percent of a zinc di-$C_{4-8}$ alkyldithiophosphate, (d) about 3-10 weight percent of diethanol amine and (e) about 5-15 weight percent of sodium alkylbenzene sulfonate.

13. A concentrate of claim 8 further characterized by containing 0.25 weight percent of a polyalkylene glycol monooleate.

14. A concentrate of claim 12 further characterized by containing about 10-20 weight percent of a polyethylene glycol monooleate.

* * * * *

UNITED STATES PATENT AND TRADEMARK OFFICE

CERTIFICATE OF CORRECTION

PATENT NO. : 4,486,324

DATED : December 4, 1984

INVENTOR(S) : Philip S. Korosec

It is certified that error appears in the above-identified patent and that said Letters Patent is hereby corrected as shown below:

Column 2, line 61, reads "--$R_1$-O)$_n$$R_1$-OH" and should read -- $(R_1\text{-}O)_n R_1\text{-}OH$ --.

Column 3, line 10, reads "soduim" and should read -- sodium --.

Column 5, line 1, reads "soduim" and should read -- sodium --.

Column 5, line 6, reads "EXAMPLE2" and should read -- EXAMPLE 2 --.

Signed and Sealed this

*Twenty-third* Day of *July 1985*

[SEAL]

*Attest:*

DONALD J. QUIGG

*Attesting Officer* *Acting Commissioner of Patents and Trademarks*